US005758743A

United States Patent [19]

Coyle et al.

[11] Patent Number: 5,758,743

[45] Date of Patent: Jun. 2, 1998

[54] PERSONAL SAFETY LANYARD ROOF ATTACHMENT APPARATUS

[76] Inventors: David W. Coyle; Horace O. Burgess, Jr., both of 2840 Armentrout Dr., P.O. Box 65, Concord, N.C. 28026

[21] Appl. No.: 846,532

[22] Filed: Apr. 29, 1997

[51] Int. Cl.[6] ..... A62B 37/00

[52] U.S. Cl. ..... 182/45; 182/3

[58] Field of Search ..... 182/45, 3, 153

[56] References Cited

U.S. PATENT DOCUMENTS

| | | | |
|---|---|---|---|
| 3,237,717 | 3/1966 | Jackson | 182/45 |
| 5,350,037 | 9/1994 | Ghahremani | 182/36 |
| 5,647,455 | 7/1997 | Russell | 182/153 |

FOREIGN PATENT DOCUMENTS

| | | | |
|---|---|---|---|
| 2157755 | 10/1985 | United Kingdom | 182/45 |

*Primary Examiner*—Alvin C. Chin-Shue

[57] ABSTRACT

A new Personal Safety lanyard Roof Attachment Apparatus for providing a convenient, versatile and secure system for preventing a worker from falling off a roof structure. The inventive device includes a top bar including a coupling adapted for retaining a personal safety lanyard, a pair of end supports each pivotally connected to the top bar at opposite ends thereof, a pair of crossbars interconnecting the pair of end supports, and a pair of clamping members secured to each of the pair of crossbars, wherein the clamping members are adapted for clamping the present invention to a roof structure. A pair of roof adaptor members are provided for securing the present invention to a finished roof structure.

11 Claims, 5 Drawing Sheets

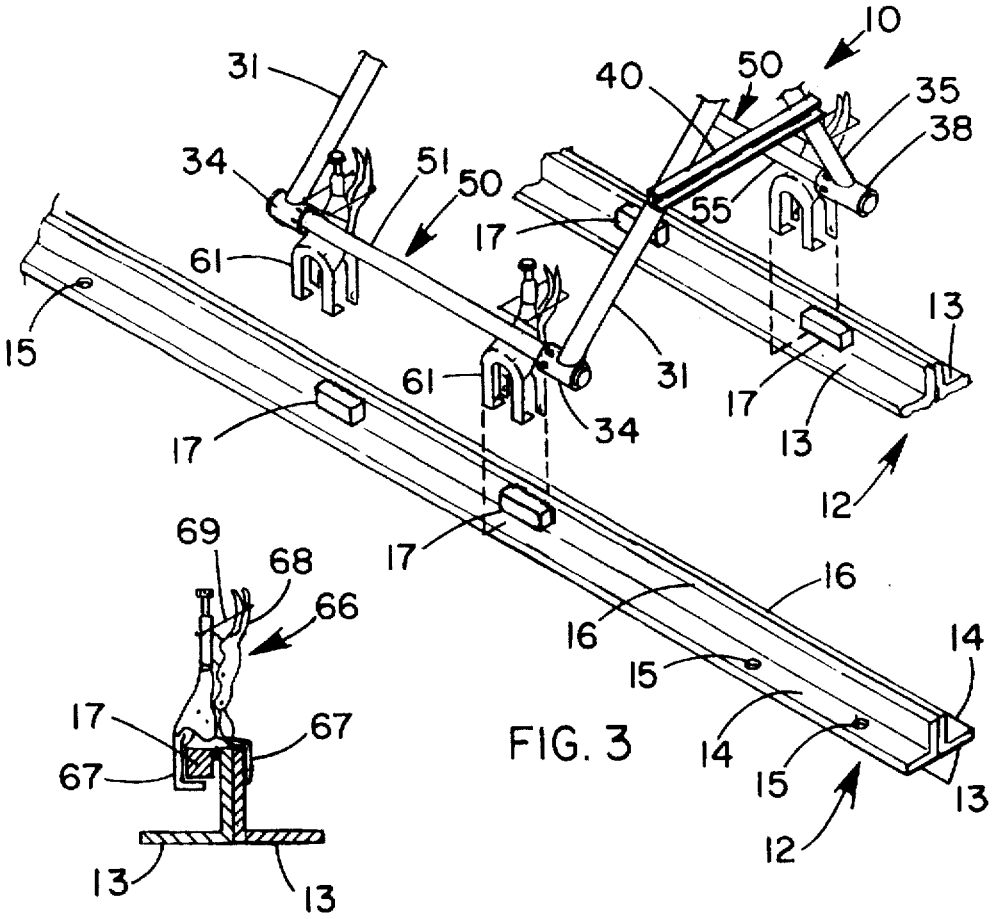
FIG. 3
FIG. 4
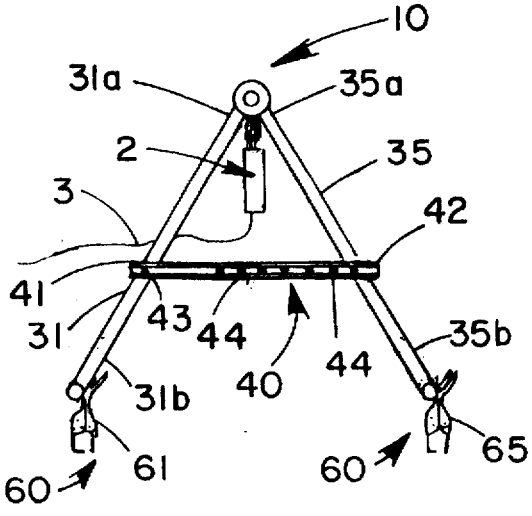
FIG. 5
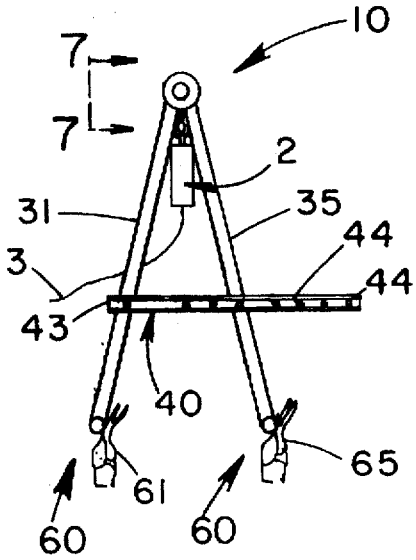
FIG. 6

FIG. 7
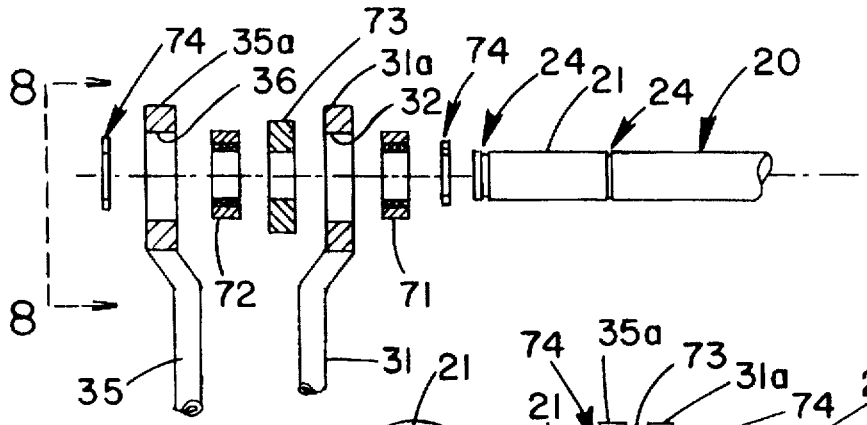
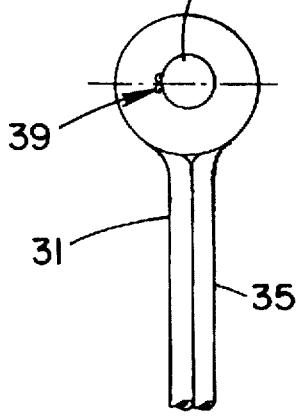
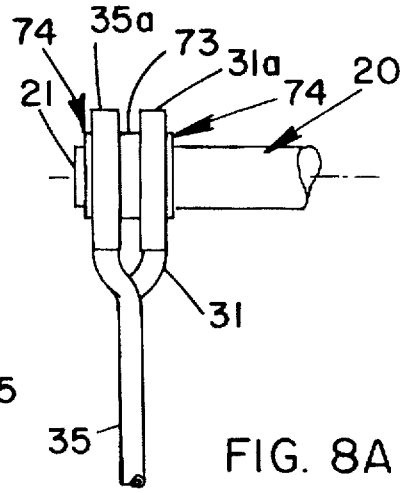
FIG. 8A
FIG. 8

PERSONAL SAFETY LANYARD ROOF ATTACHMENT APPARATUS

BACKGROUND OF THE INVENTION

1. Field of the Invention

The present invention relates to roofing safety devices and more particularly pertains to a new Personal Safety Lanyard Roof Attachment Apparatus for providing a convenient, versatile and secure system for preventing a worker from falling off a roof structure.

2. Description of the Prior Art

The use of roofing safety devices is known in the prior art. More specifically, roofing safety devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art roofing safety devices include U.S. Pat. No. 4,942,943; U.S. Pat. No. 4,607,724; U.S. Pat. No. 254,534; U.S. Pat. No. 5,287,944; U.S. Pat. No. 4,928,790; and U.S. Pat. No. 4,721,182.

While these devices fulfill their respective, particular objectives and requirements, the aforementioned patents do not disclose a new Personal Safety lanyard Roof Attachment Apparatus. The inventive device includes a top bar including a coupling adapted for retaining a personal safety lanyard, a pair of end supports each pivotally connected to the top bar at opposite ends thereof, a pair of crossbars interconnecting the pair of end supports, and a pair of clamping members secured to each of the pair of crossbars, wherein the clamping members are adapted for clamping the Roof Attachment Apparatus to a roof structure.

In these respects, the Personal Safety Lanyard Roof Attachment Apparatus according to the present invention substantially departs from the conventional concepts and designs of the prior art, and in so doing provides an apparatus primarily developed for the purpose of providing a convenient, versatile and secure system for preventing a worker from falling off a roof structure.

SUMMARY OF THE INVENTION

In view of the foregoing disadvantages inherent in the known types of roofing safety devices now present in the prior art, the present invention provides a new Personal Safety Lanyard Roof Attachment Apparatus construction wherein the same can be utilized for providing a convenient, versatile and secure system for preventing a worker from falling off a roof structure.

The general purpose of the present invention, which will be described subsequently in greater detail, is to provide a new Personal Safety Lanyard Roof Attachment Apparatus apparatus and method which has many of the advantages of the roofing safety devices mentioned heretofore and many novel features that result in a new Personal Safety Lanyard Roof Attachment Apparatus which is not anticipated, rendered obvious, suggested, or even implied by any of the prior art roofing safety devices, either alone or in any combination thereof.

To attain this, the present invention generally comprises a top bar including a coupling adapted for retaining a personal safety lanyard, a pair of end supports each pivotally connected to the top bar at opposite ends thereof, a pair of crossbars interconnecting the pair of end supports, and a pair of clamping members secured to each of the pair of crossbars, wherein the clamping members are adapted for clamping the Roof Attachment Apparatus to a roof structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who arc not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Personal Safety Lanyard Roof Attachment Apparatus apparatus and method which has many of the advantages of the roofing safety devices mentioned heretofore and many novel features that result in a new Personal Safety Lanyard Roof Attachment Apparatus which is not anticipated, rendered obvious, suggested, or even implied by any of the prior art roofing safety devices, either alone or in any combination thereof.

It is another object of the present invention to provide a new Personal Safety Lanyard Roof Attachment Apparatus which may be easily and efficiently manufactured and marketed.

It is a further object of the present invention to provide a new Personal Safety Lanyard Roof Attachment Apparatus which is of a durable and reliable construction.

An even further object of the present invention is to provide a new Personal Safety Lanyard Roof Attachment Apparatus which is susceptible of a low cost of manufacture with regard to both materials and labor, and which accordingly is then susceptible of low prices of sale to the consulting public, thereby making such Personal Safety Lanyard Roof Attachment Apparatus economically available to the buying public.

Still yet another object of the present invention is to provide a new Personal Safety Lanyard Roof Attachment Apparatus which provides in the apparatuses and methods of the prior art some of the advantages thereof, while simultaneously overcoming some of the disadvantages normally associated therewith.

Still another object of the present invention is to provide a new Personal Safety Lanyard Roof Attachment Apparatus for providing a convenient, versatile and secure system for preventing a worker from falling off a roof structure.

Yet another object of the present invention is to provide a new Personal Safety Lanyard Roof Attachment Apparatus which includes a top bar including a coupling adapted for retaining a personal safety lanyard, a pair of end supports each pivotally connected to the top bar at opposite ends thereof, a pair of crossbars interconnecting the pair of end supports, and a pair of clamping members secured to each of the pair of crossbars, wherein the clamping members are adapted for clamping the Roof Attachment Apparatus to a roof structure.

Still yet another object of the present invention is to provide a new Personal Safety Lanyard Roof Attachment Apparatus that can be secured to a wide variety of roof configurations.

Even still another object of the present invention is to provide a new Personal Safety Lanyard Roof Attachment Apparatus that can be quickly and easily installed and relocated so as to reduce the amount of time required to set up a roof safety device thus enabling a worker to be more productive.

Even still another object of the present invention is to provide a new Personal Safety Lanyard Roof Attachment Apparatus that could reduce accidents and thus potentially reduce insurance premiums.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an illustration of the roof adaptor members of the present invention.

FIG. 4 is an illustration of a clamping member of the present invention clamped to the roof adaptor members of the present invention.

FIG. 5 is a side view of the present invention.

FIG. 6 is a side view of the present invention.

FIG. 7 is an exploded illustration of the coupling of the legs of one of the end supports to the top bar.

FIG. 8 is a view from the perspective of line 8—8 of FIG. 7.

FIG. 8*a* is an illustration of the legs of the end supports coupled to the top bar.

DESCRIPTION OF THE PREFERRED EMBODIMENT

Figure 1:
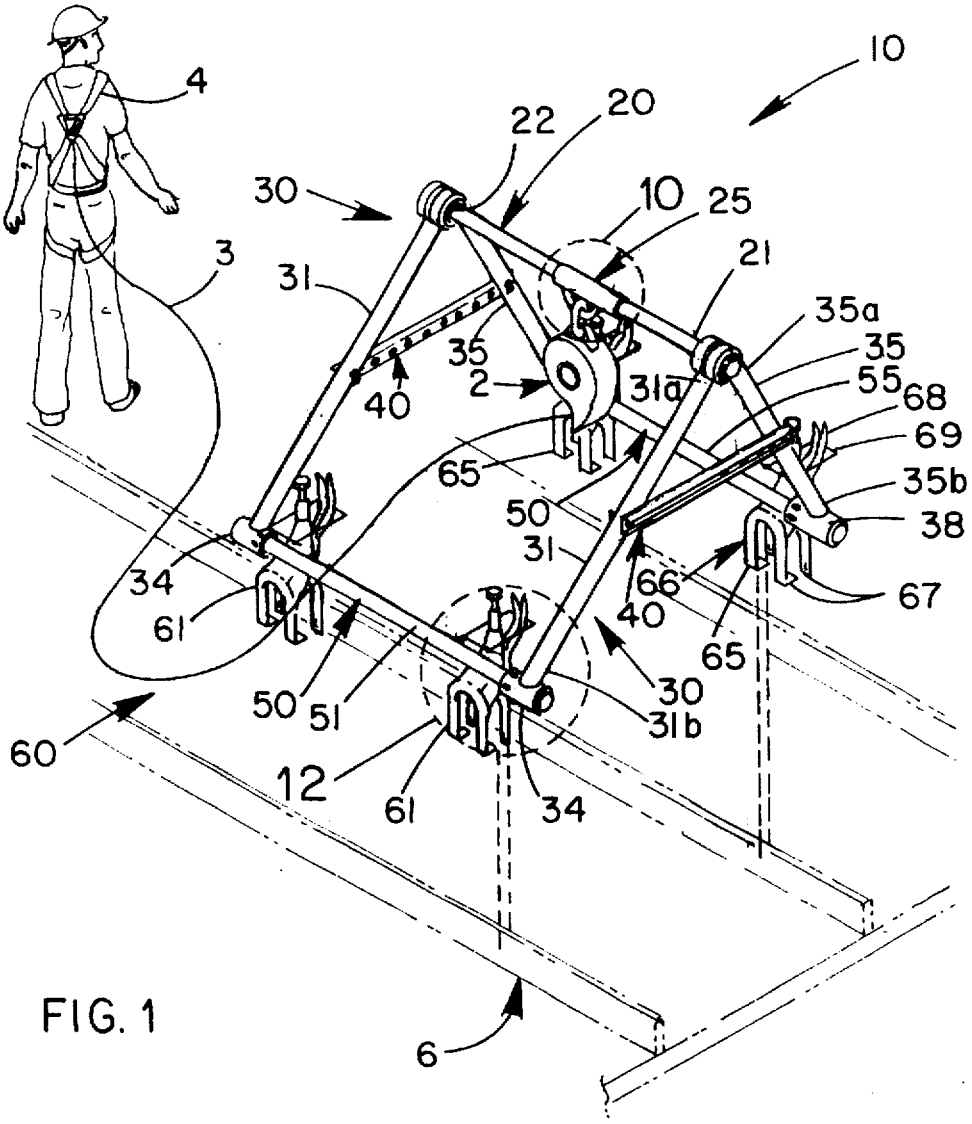
FIG. 1 is an illustration of a new Personal Safety Lanyard Roof Attachment Apparatus according to the present invention.

With reference now to the drawings, and in particular to FIGS. 1 through 14 thereof, a new Personal Safety Lanyard Roof Attachment Apparatus embodying the principles and concepts of the present invention and generally designated by the reference numeral 10 will be described.

More specifically, it will be noted that the Personal Safety Lanyard Roof Attachment Apparatus 10 comprises a top bar 20 including a coupling 25 adapted for retaining a personal safety lanyard 2, a pair of end supports 30 each pivotally connected to the top bar 20 at opposite ends thereof, a pair of crossbars 50 interconnecting the pair of end supports 30, and a pair of clamping members 60 secured to each of the pair of crossbars 50, wherein the clamping members 60 are adapted for clamping the Roof Attachment Apparatus 10 to a roof structure 6.

As best illustrated in FIG. 1, it can he shown that the Roof Attachment Apparatus 10 is intended for use with a personal safety lanyard 2. The personal safety lanyard 2 includes a retractable safety line 3 secured at one end to a retraction mechanism (not shown). The retractable safety line 3 is attachable at a free end to a safety harness 4 being worn by a worker. The retraction mechanism allows the retractable safety line 3 to be unwound as the worker moves about and prevents significant slack from developing in the retractable safety line 3. However, the retraction mechanism locks and prevents further release of the retractable safety line 3 if the worker falls and places a sudden load on the retractable safety line 3.

Figure 10:
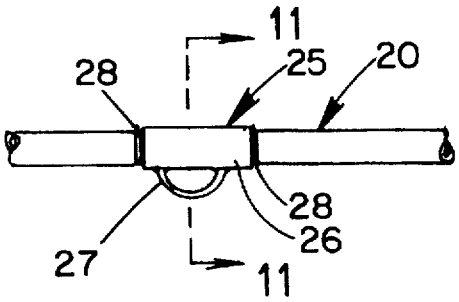
FIG. 10 is an illustration of area 10 of FIG. 1 showing the lanyard coupling of the present invention.
Figure 11:
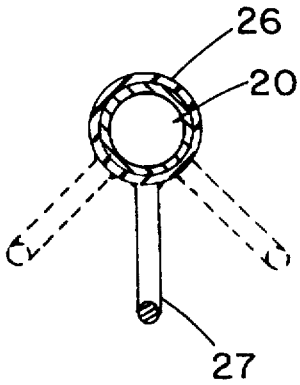
FIG. 11 is a cross sectional view taken along line 11—11 of FIG. 10.

The top bar 20 has a first end 21 and a second end 22. The coupling 25, adapted for retaining the personal safety lanyard 2, is provided intermediate the first end 21 and the second end 22 of the top bar 20. As best illustrated in FIGS. 10 and 11, it can be shown that the coupling 25 comprises a top sleeve 26 rotatingly coupled to the top bar 20 and a loop 27 attached to the top sleeve 26 into which the personal safety lanyard 2 may be attached. The top sleeve 26 is retained intermediate the first end 21 and the second end 22 of the top bar 20 by a pair of retaining rings 28 provided on opposite ends of the top sleeve 26. Each of the pair of retaining rings 28 is fitted within one of a pair of spaced grooves 23 provided in the top bar 20 near a midpoint thereof.

As best illustrated in FIG. 1, it can be shown that each of the pair of end supports 30 is A-shaped and includes a first leg 31 and a second leg 35 wherein the first leg 31 and the second leg 35 each have a first end 31*a* and 35*a*, respectively, and a second end 31*b* and 35*b*, respectively. As best illustrated in FIGS. 7, 8, and 8*a*, it can be shown that the first leg 31 and the second leg 35 are each pivotally connected at the first ends 31*a* and 35*a*, respectively, thereof to the top bar 20. The first leg 31 and the second leg 35 each have an end hole 32 and 36, respectively, therethrough adjacent the first ends 31*a* and 35*a*, respectively, thereof. A first bearing 71 is fitted within the end hole 32 of the first leg 31 and a second bearing 72 is fitted within the end hole 36 of the second leg 35. The first bearing 71 and the second bearing 72 rotatingly couple the first leg 31 and the second leg 35 to the top bar 20. A spacer 73 is disposed between the first end 31*a* of the first leg 31 and the first end 35*a* of the second leg 35.

The first leg 31 and the second leg 35 are retained on the top bar 20 by a pair of retaining rings 74. Each of the pair of retaining rings 74 is fitted within one of a pair of spaced end grooves 24 provided in the top bar 20 adjacent the first and second ends 21 and 22, respectively, thereof. The second end 31*b* of the first leg 31 and the second end 35*b* of the second leg 35 each terminate with an end sleeve 34 and 38, respectively.

An adjustment bar 40 interconnects the first leg 31 and the second leg 35 intermediate the first and second ends thereof. The adjustment bar 40 has a first end 41 and a second end 42. The adjustment bar 40 has a first hole 43 therein adjacent the first end 41 thereof and has a plurality of spaced adjustment holes 44 therein between the first end 41 and the second end 42 thereof.

Figure 9:
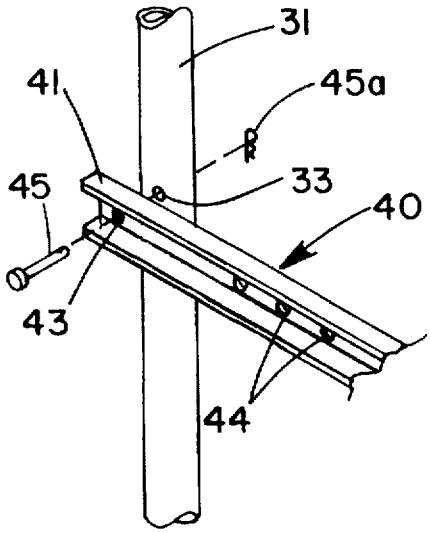
FIG. 9 is an illustration of the adjustment bar coupled to one of the legs of the end supports.

As best illustrated in FIG. 9, it can be shown that the adjustment bar 40 is coupled to the first leg 31 by a first pin 45 fitted through the first hole 43 provided in the adjustment bar 40 and fitted through an intermediate hole 33 provided in the first leg 31 intermediate the first end 31*a* and the second end 31*b* thereof. A cotter pin 45*a* is provided for securing the first pin 45. The adjustment bar 40 is coupled to the second leg 35 by an adjustment pin 46 fitted through one of the plurality of spaced adjustment holes 44 provided in the adjustment bar 40 and fitted through an intermediate hole 37 provided in the second leg 35 intermediate the first end 35*a* and the second end 35*b* thereof. As best illustrated in FIGS. 5 and 6, it can be shown that the distance between the first leg 31 and the second leg 35 may be adjusted by pivoting tile first leg 31 and the second leg 35 away from or towards each other and fitting the adjustment pin 46 through another of the plurality of spaced adjustment holes 44 provided in the adjustment bar 40. A cotter pin 46*a* is provided for securing the adjustment pin 46.

The pair of crossbars 50 comprises a first crossbar 51 and a second crossbar 55 wherein the first crossbar 51 and the second crossbar 55 each have a first end 51*a* and 55*a*, respectively, and a second end 51*b* and 55*b*, respectively. The first end 51*a* of the first crossbar 51 is rotatably coupled to the second end 31*b* of the first leg 31 of one of the pair of end supports 30 and the second end 51*b* of the first crossbar 51 is rotatably coupled to the second end 31*b* of the first leg 31 of another of the pair of end supports 30. The first end 55*a* of the second crossbar 55 is rotatably coupled to the second end 35*b* of the second leg 35 of one of the pair of end supports 30 and the second end 55*b* of the second crossbar 55 is rotatably coupled to the second end 35*b* of the second leg 35 of another of the pair of end supports 30.

Figure 12:
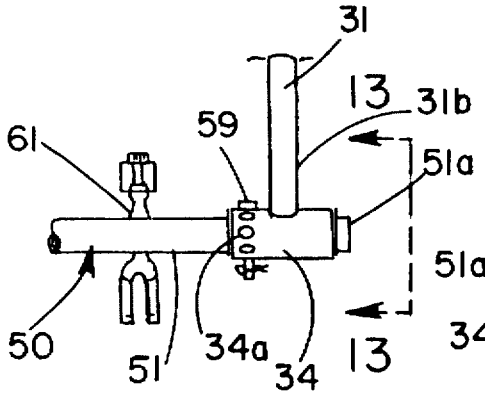
FIG. 12 is an illustration of area 12 of FIG. 1 showing a clamping member, a crossbar, and a leg of one of the end supports of the present invention.
Figure 13:
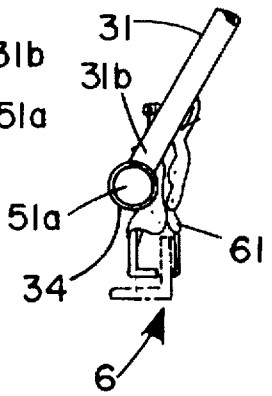
FIG. 13 is a cross sectional view taken along line 13—13 of FIG. 12 showing the clamping of one of the clamping members to a structural member.
Figure 13A:
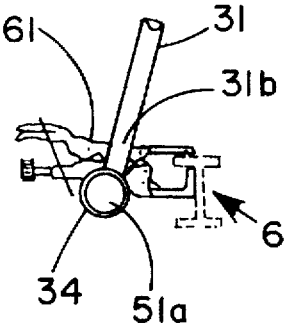
FIG. 13*a* is an additional illustration showing the clamping of one of the clamping members to a structural member.
Figure 14:
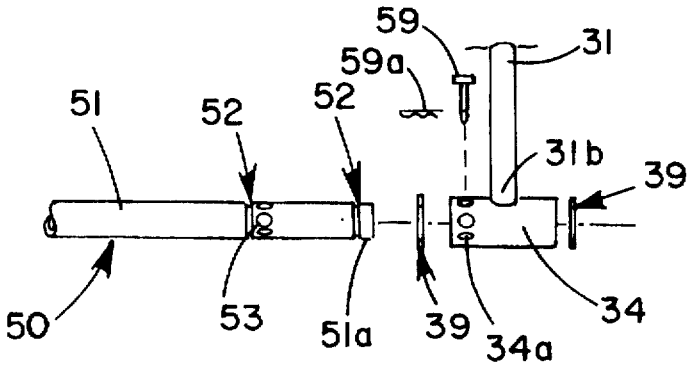
FIG. 14 is an exploded illustration of the coupling of a crossbar to a leg of one of the end supports of the present invention.

As best illustrated in FIGS. 12 through 14, it can be shown that the first and second ends 51*a* and 51*b*, respectively, of the first crossbar 51 fit within the end sleeve 34 provided at the second end 31*b* of the first leg 31 of each of the pair of end supports 30. The first and second ends 55*a* and 55*b*, respectively, of the second crossbar 55 fit within the end sleeve 38 provided at the second end 35*b* of the second leg 35 of each of the pair of end supports 30. As such, the first crossbar 51 and the second crossbar 55 are rotatably coupled to the pair of end supports 30. Each of the first and second ends of the first and second crossbars 51 and 55, respectively, are retained within each end sleeve 34 and 38 by a pair of retaining rings 39 provided on opposite ends of each end sleeve 34 and 38. The first crossbar 51 and the second crossbar 55 each have a pair of spaced grooves 52 and 56, respectively, therein adjacent the first and second ends thereof. Each of the pair of retaining rings 39 is fitted within one of the pair of spaced grooves 52 and 56 provided in each of the first crossbar 51 and the second crossbar 55.

Each end sleeve 34 and 38 has a plurality of aligned holes 34*a* and 38*a*, respectively, therein and the first crossbar 51 and the second crossbar 55 each have a plurality of bores 53 and 57, respectively, therethrough. One of the plurality of aligned holes 34*a* and 38*a* is alignable with one of the plurality of bores 53 and 57 such that a lock pin 59 may be inserted therethrough for locking rotation of the first crossbar 51 and the second crossbar 55. A cotter pin 59*a* is provided for securing the lock pin 59.

The pair of clamping members 60 comprises a first pair of clamping members 61 secured to the first crossbar 51 and a second pair of clamping members 65 secured to the second crossbar 55. As such, the first pair of clamping members 61 and the second pair of clamping members 65 rotate with the first crossbar 51 and the second crossbar 55, respectively. One of the first pair of clamping members 61 is secured to the first crossbar 51 adjacent the first end 51*a* thereof and another of the first pair of clamping members 61 is secured to the first crossbar 51 adjacent the second end thereof 51*b*. One of the second pair of clamping members 65 is secured to the second crossbar 55 adjacent the first end 55*a* thereof and another of the second pair of clamping members 65 is secured to the second crossbar 55 adjacent the second end 55b thereof.

Each of the first pair of clamping members 61 and the second pair of clamping members 65 comprises an adjustable clamp 66 including a pair of clamping jaws 67 adapted for clamping thereof to the roof structure 6. The adjustable clamp 66 includes a clamping handle 68 for clamping the pair of clamping jaws 67 and the clamping handle 68 includes a lock ring 69 for locking the clamping handle 68 in a clamped position.

Figure 2:
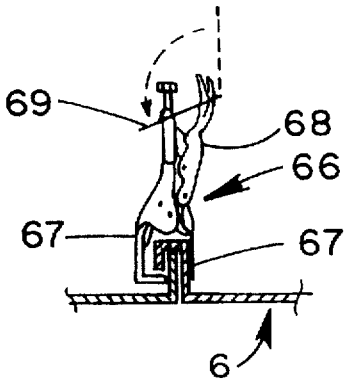
FIG. 2 is an illustration of a clamping member of the present invention clamped to a standing seam roof.

As best illustrated in FIG. 1, it can he shown that the Roof Attachment Apparatus 10 may be secured to an open roof structure, including a standing seam roof (FIG. 2). Additionally, the Roof Attachment Apparatus 10 may be secured to a finished roof structure with the use of a pair of roof adaptor members 12. As best illustrated in FIGS. 3 and 4, it can be shown that each of the pair of roof adaptor members 12 comprises a pair of elongated L-shaped members 13 joined back-to-back to form an inverted T-shaped member. Each of the pair of elongated L-shaped members 13 includes a horizontal leg 14 and a vertical leg 16 wherein the vertical leg 16 of one of the pair of elongated L-shaped members 13 is joined to the vertical leg 16 of another of the pair of elongated L-shaped members 13.

The horizontal leg 14 of each of the pair of elongated L-shaped members 13 has a plurality of holes 15 therein adapted for receiving a fastener (not shown) used to secure each of the pair of elongated L-shaped members 13 to a finished roof structure. A pair of clamping blocks 17 are attached to the vertical leg 16 of one of the pair of elongated L-shaped members 13. The pair of clamping blocks 17 are spaced such that the pair of clamping members 60 may be clamped onto the pair of clamping blocks 17 for securing the Roof Attachment Apparatus 10 to each of the pair of roof adaptor members 12 when secured to a finished roof structure.

In use, the first leg 31 and the second leg 35 of each of the pair of end supports 30 are adjusted such that the first pair of clamping members 61 and the second pair of clamping members 65 may be clamped to the roof structure 6. The first leg 31 and the second leg 35 are adjusted by pivoting thereof and relocating the adjustment pin 46 in one of the plurality of spaced adjustment holes 44 provided in the adjustment bar 40. The first crossbar 51 and the second crossbar 55 are rotated for optimal clamping of the first pair of clamping members 61 and the second pair of clamping members 65 to the roof structure 6. Thereafter, the first pair of clamping members 61 and the second pair of clamping members 65 are clamped to the roof structure 6.

Alternatively, the pair of roof adaptor members 12 may be secured to the roof structure 6 and the pair of clamping members 60 may be clamped to the pair of roof adaptor members 12. The pair of roof adaptor members 12 are secured to the roof structure 6 by use of fasteners inserted through the plurality of holes 15 provided in the horizontal leg 14 of each of the pair of elongated L-shaped members 13. Thereafter, the pair of clamping members 60 are clamped to the pair of clamping blocks 17 provided on the vertical leg 16 of one of the pair of elongated L-shaped members 13.

Once the Roof Attachment Apparatus 10 is secured to the roof structure 6, the personal safety lanyard 2 is attached to the loop 27 of the coupling 25 and the free end of the retractable safety line 3 is attached to the safety harness 4 being worn by the worker. As such, if the worker were to start to fall, the retraction mechanism of the personal safety lanyard 2 would lock and prevent further release of the retractable safety line 3 thereby preventing the worker from falling to the ground below.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roof attachment apparatus for use with a personal safety lanyard, said roof attachment apparatus comprising:

a top bar including a coupling adapted for retaining said personal safety lanyard;

a pair of end supports each pivotally connected to said top bar at opposite ends thereof;

a pair of crossbars interconnecting said pair of end supports; and a pair of clamping members secured to each of said pair of crossbars, said clamping members adapted for clamping said roof attachment apparatus to a roof structure.

2. The roof attachment apparatus of claim 1, wherein said coupling comprises:

a top sleeve rotatingly coupled to said top bar, and a loop attached to said top sleeve into which said personal safety lanyard may be attached.

3. The roof attachment apparatus of claim 2, wherein said top bar has a first end and a second end, and wherein said coupling is provided intermediate said first end and said second end of said top bar.

4. The roof attachment apparatus of claim 1, wherein each of said pair of end supports is A-shaped and comprises:

a first leg and a second leg, said first leg and said second leg each having a first end and a second end, said first leg and said second leg each pivotally connected at said first ends thereof to said top bar, and an adjustment bar interconnecting said first leg and said second leg intermediate said first and second ends thereof.

5. The roof attachment apparatus of claim 4, wherein said adjustment bar has a first end and a second end, said adjustment bar having a first hole therein adjacent said first end thereof and having a plurality of spaced adjustment holes therein between said first end and said second end thereof, wherein said adjustment bar is coupled to said first leg by a first pin fitted through said first hole provided in said adjustment bar and fitted through an intermediate hole provided in said first leg intermediate said first end and said second end thereof, and wherein said adjustment bar is coupled to said second leg by an adjustment pin fitted through one of said plurality of spaced adjustment holes provided in said adjustment bar and fitted through an intermediate hole provided in said second leg intermediate said first end and said second end thereof.

6. The roof attachment apparatus of claim 4, wherein said pair of crossbars comprises:

a first crossbar and a second crossbar, said first crossbar and said second crossbar each having a first end and a second end, said first end of said first crossbar rotatably coupled to said second end of said first leg of a first of said pair of end supports and said second end of said first crossbar rotatably coupled to said second end of said first leg of a second of said pair of end supports, said first end of said second crossbar rotatably coupled to said second end of said second leg of said first of said pair of end supports and said second end of said second crossbar rotatably coupled to said second end of said second leg of said second of said pair of end supports.

7. The roof attachment apparatus of claim 4, further comprising:

an end sleeve provided at each of said second end of said first leg and said second end of said second leg of each of said pair of end supports, and wherein a first of said pair of crossbars rotatably fits within said end sleeve provided at said second end of said first leg of each of said pair of end supports, and wherein a second of said pair of crossbars rotatably fits within said end sleeve provided at said second end of said second leg of each of said pair of end supports.

8. The roof attachment apparatus of claim 7, wherein said end sleeve has a plurality of aligned holes therein, and wherein each of said pair of crossbars have a plurality of bores therethrough adjacent both ends thereof, one of said plurality of aligned holes alignable with one of said plurality of bores such that a lock pin may be inserted therethrough for locking rotation of each of said pair of crossbars.

9. The roof attachment apparatus of claim 6, wherein said pair of clamping members comprises:

a first pair of clamping members secured to said first crossbar, and a second pair of clamping members secured to said second crossbar, whereby said first pair of clamping members and said second pair of clamping members rotate with said first crossbar and said second crossbar, respectively.

10. The roof attachment apparatus of claim 1, further comprising:

a pair of roof adaptor members removably attachable to said roof structure, said pair of clamping members clampable to said pair of roof adaptors members.

11. The roof attachment apparatus of claim 10, wherein each of said pair of roof adaptor members comprises:

a pair of elongated L-shaped members, each of said pair of elongated L-shaped members including a horizontal leg and a vertical leg, said vertical leg of one of said pair of elongated L-shaped members joined to said vertical leg of another of said pair of elongated L-shaped members so as to form an inverted T-shaped member, said horizontal leg of at least one of said pair of elongated L-shaped members having a plurality of holes therein adapted for receiving a fastener used to secure said pair of elongated L-shaped members to said roof structure, and a pair of clamping blocks attached to said vertical leg of one of said pair of elongated L-shaped members, said pair of clamping blocks adapted for clamping of said pair of clamping members thereto.

* * * * *